US005638553A

United States Patent [19]

Loewen et al.

[11] Patent Number: 5,638,553

[45] Date of Patent: Jun. 17, 1997

[54] TOILET VENTILATION SYSTEM

[76] Inventors: Peter Loewen, 14521 Montana Ave., Sp. 25, El Paso, Tex. 79938; David L. Volk, 301 Oakwood Ct., Clairton, Pa. 15025

[21] Appl. No.: 700,926

[22] Filed: Aug. 23, 1996

[51] Int. Cl.[6] ..... E03D 9/052

[52] U.S. Cl. ..... 4/217; 4/213

[58] Field of Search ..... 4/213, 217, 347, 4/352

[56] References Cited

U.S. PATENT DOCUMENTS

| | | | |
|---|---|---|---|
| 2,728,088 | 12/1955 | Gudish | 4/217 |
| 3,020,564 | 2/1962 | Chodacki et al. | 4/213 |
| 3,108,289 | 10/1963 | Smith | 4/217 |
| 3,916,459 | 11/1975 | Ivancevic | 4/217 |
| 4,780,913 | 11/1988 | Williams | 4/213 |
| 5,575,019 | 11/1996 | Kijewski | 4/213 |

*Primary Examiner*—Henry J. Recla
*Assistant Examiner*—Charles R. Eloshway
*Attorney, Agent, or Firm*—David L. Volk; Brendan B. Dix

[57] ABSTRACT

A seat includes first slots therein for drawing air from the vicinity of a toilet rim into the seat. A second slot is disposed at one end of the seat and is in environmental communication with the first slots. The seat includes a sleeve at one end for receiving a tube to become pivotal about the tube. Anchors secure the the tube to a toilet. A tube slot within the tube is configured to align with the second slot when the seat is in a closed position. The sleeve is configured to cover the tube slot when the seat is in an open position. The tube includes an open first end. A duct fits the first end of the tube. A fan connects to the duct and discharges air to a suitable location.

2 Claims, 4 Drawing Sheets

TOILET VENTILATION SYSTEM

BACKGROUND - FIELD OF INVENTION

This invention relates to mechanical exhaust systems, specifically to a system for exhausting air from the area near a toilet seat.

BACKGROUND - DESCRIPTION OF PRIOR ART

Typically, toilet odors are removed via a fan installed in the ceiling of a bathroom or restroom. The problem is that the inlet to this type of system is located at the ceiling. This arrangement permits toilet odor to permeate the room before it is removed.

What is needed is a simply constructed apparatus for removing air from the vicinity of the toilet seat where the odors are created. Such a system would increase the likelihood that odor will be removed before it permeates the room.

SUMMARY

The toilet ventilation system of the present invention includes a seat having first slots therein for drawing air from the vicinity of a toilet rim into the seat. A second slot is disposed at one end of the seat and is in environmental communication with the first slots. The seat includes a sleeve at one end for receiving a tube to become pivotal about the tube. Anchors secure the tube to a toilet. A tube slot within the tube is configured to align with the second slot when the seat is in a closed position. The sleeve is configured to cover the tube slot when the seat is in an open position. The tube includes an open first end. A duct fits the first end of the tube. A fan connects to the duct and discharges air to a suitable location.

DETAILED DESCRIPTION

Figure 1:
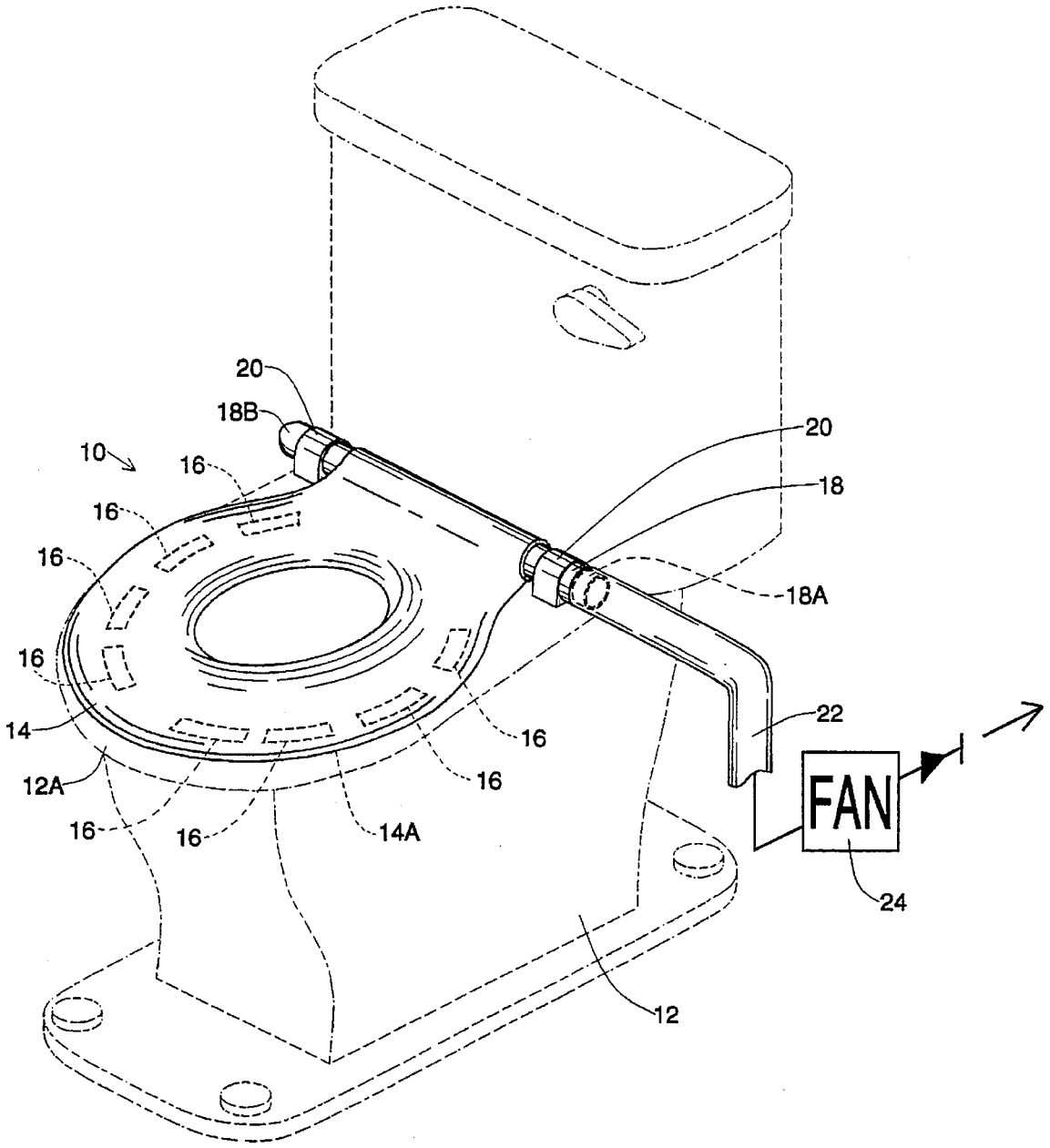
FIG. 1 is a perspective view of the toilet ventilation system installed on a toilet.

FIG. 1 is a perspective view of a toilet ventilation system 10 installed on a toilet 12. A seat 14 includes first slots 16 in a rim facing surface 14A thereof. Air is drawn through the first slots 16 to ventilate the surrounding area. The seat 14 is pivotally connected to a tube 18. The tube 18 is positioned behind the toilet rim 12A and is anchored to the toilet 12 via two anchors 20. An exhaust duct 22 is connected to a first end 18A of the tube 18. The exhaust duct 22 is connected to a fan 24 which discharges air to a suitable location (not shown) such as outdoors or an attic space.

Figure 2:
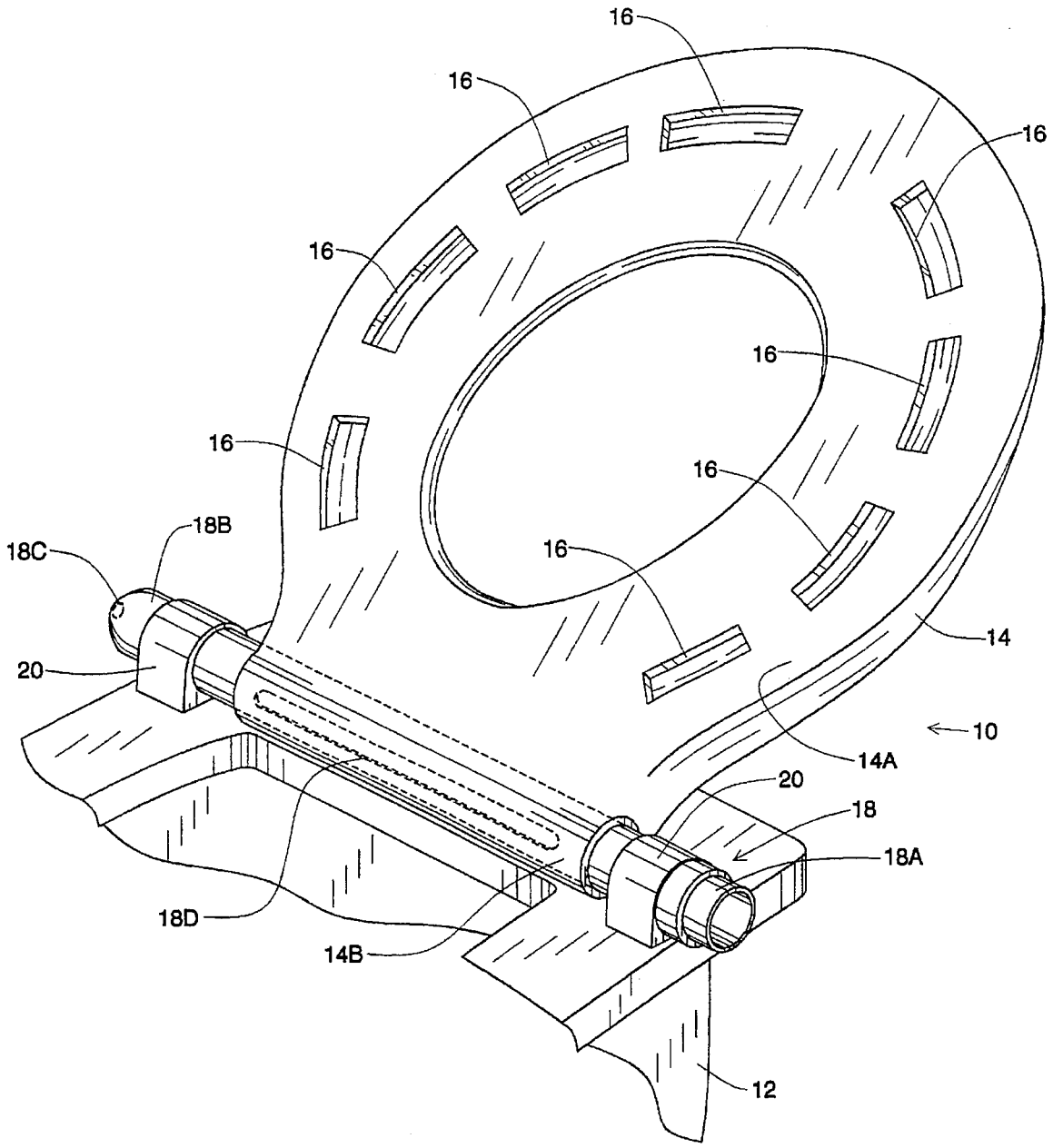
FIG. 2 is a partial enlarged perspective view of the toilet ventilation system installed on a toilet, with the seat in an up position to reveal the bottom thereof.

FIG. 2 is a partial enlarged perspective view of the toilet ventilation system 10 installed on the toilet 12, with the seat 14 in an up position to reveal the rim-facing surface 14A thereof. The duct 22 and the fan 24 are not shown in this figure, in order to better show the tube 18. The tube 18 is open at its first end 18A, and includes a small port 18C in a second end 18B of the tube 18. The tube 18 includes a tube slot 18D which generally faces the front of the toilet 12. The tube 18 is fixedly connected via anchors 20 to the toilet 12.

The seat 14 includes a sleeve 14B at one end thereof. The sleeve 14B receives the tube 18, the seat 14 thereby being pivotal about the tube 18.

Figure 3:
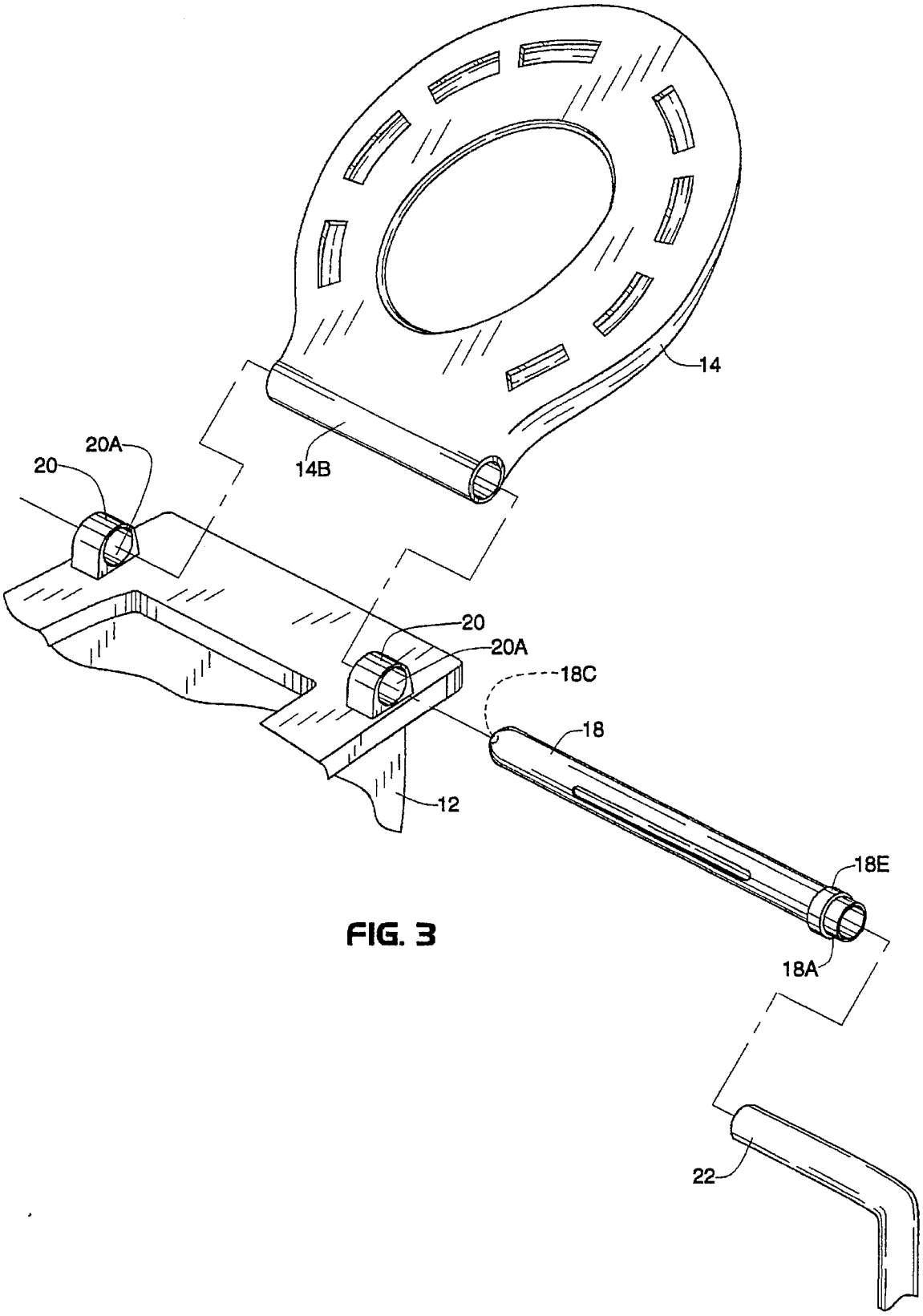
FIG. 3 is an exploded view of the toilet ventilation system installed on a toilet.

FIG. 3 is an exploded view of the toilet ventilation system 10 installed on the toilet 12. The tube 18 is inserted through apertures 20A in the anchors 20 and through the sleeve 14B. A stop 18E disposed near the first end 18A of the tube 18 is configured to limit the penetration of the first end 18A into the duct 22. When the first end 18A is inserted into the duct 22, the duct 22 butts against the stop 18E and is limited from further movement in the direction of the stop 18E.

Figure 4:
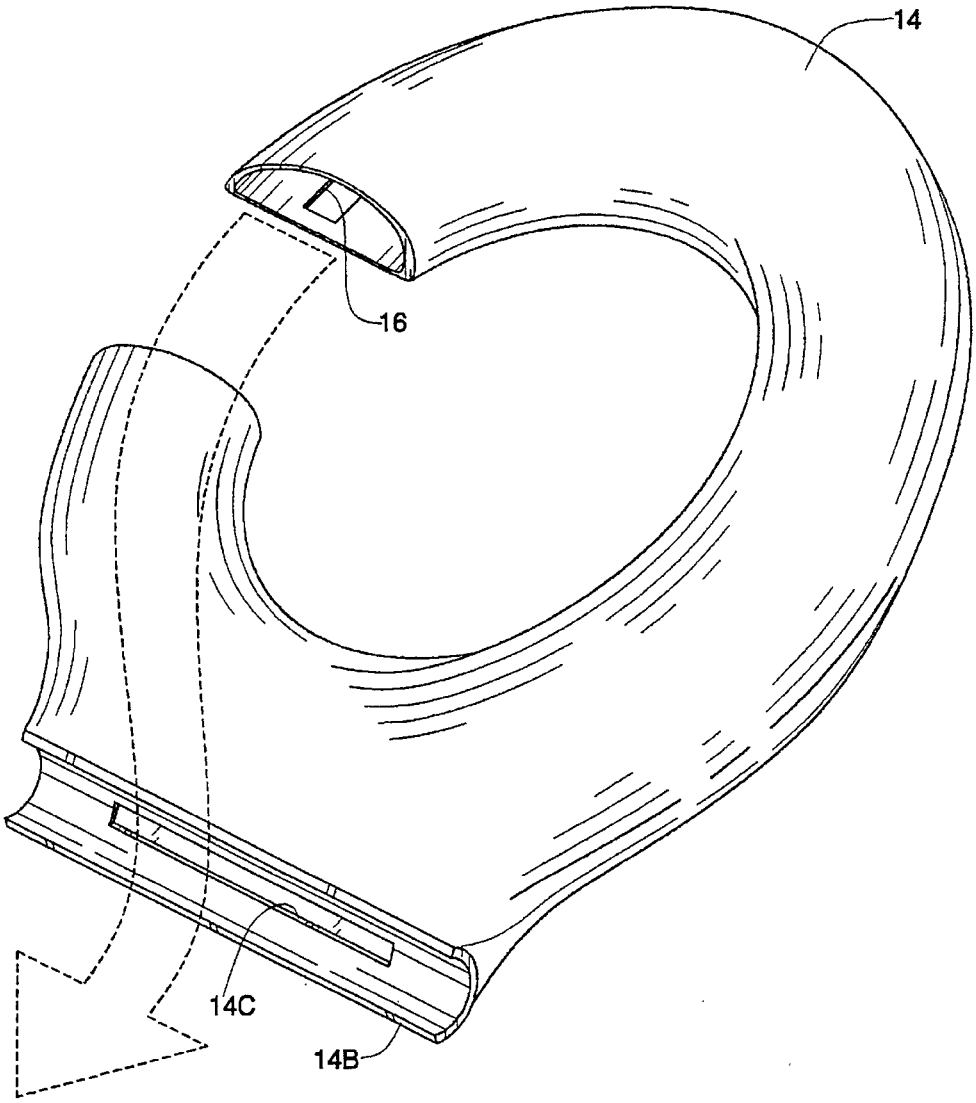
FIG. 4 is a perspective view of the toilet seat with portions broken away to show important structure.

FIG. 4 is a perspective view of the toilet seat 14 with portions broken away to show important structure. A second slot 14C is disposed in the sleeve 14B, facing the seat 14. As can be seen is this view, the seat 14 is substantially hollow, and air which is drawn by the fan 24 through the first slots 16 will enter the seat 14 and travel through the second slot 14C. Comparing FIG. 4 with FIGS. 1 and 2, it can be seen that when the seat 14 is in a down position that the second slot 14C and the tube slot 18D will line up with each other. Air drawn through the second slot 14C will enter the tube 18 through the tube slot 18D, then travel through the tube 18 into the duct 22, then to the fan 24, finally being discharged to a suitable location.

Referring back to FIG. 2, when the seat 14 is in the up position, the tube slot 18D is covered. Because the toilet 12 may be used for male urination when the seat 14 is in the up position, urine could potentially enter the tube slot 18D if it were left uncovered, thus the present invention provides a sanitary condition when the seat 14 is in the up position.

The aperture 18C in the second end 18B of the tube 18 is provided to allow for the movement of air to the fan 24 in a condition when the fan 24 is on and the seat 14 is in the up position. If the aperture 18C were not provided, the fan 24 would be subject to stalling when the seat 14 is in the up position.

The tube slot 18D and the aperture 18C are sized so that when the seat 14 is down, a large majority of the air being exhausted is drawn through the tube slot 18D, and when the seat 14 is in the up position, only enough air to keep the fan 24 from stalling or becoming objectionably noisy is drawn through the aperture 18C. Since the sizing of the tube slot 18D and the aperture 18C is a simple matter of fluid dynamics and easily accomplished by one skilled in the art, such sizing is not disclosed herein.

Figure 5:
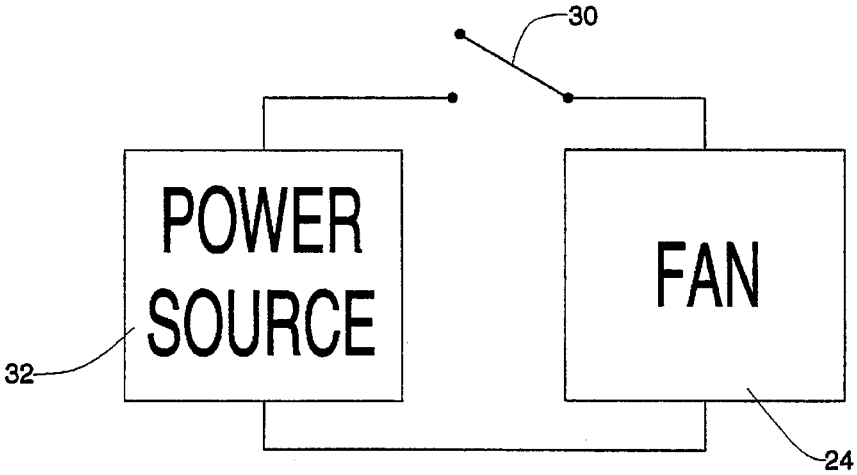
FIG. 5 is a schematic of the fan operating circuit.

FIG. 5 is a schematic of the fan operating circuit, showing a switch 30 in series with a power source 32 and the fan 24. Because other components which may be required in the circuitry such as resistors, fuses, disconnects and overload devices are well known in the prior art, such details are not disclosed herein. The power source 32 may be a 120 volt outlet, an electrical distribution panel, a battery, or other conventional source. The switch 30 may be a wall switch, a motion sensor, a pressure switch, or any other known device or system.

Thus the toilet ventilation system 10 of the present invention exhausts offensive air from the vicinity of a toilet bowl before odor has a chance to permeate a room, and maintains a sanitary condition when the toilet seat 14 is in the up position by covering the tube slot 18D.

While the above description contains many specific details, these should not be construed as limitations on the scope of the invention, but rather as an exemplification of one embodiment thereof.

Accordingly, the scope of the invention should be determined not by the embodiment illustrated, but by the appended claims and their legal equivalents.

The invention claimed is:

1. A toilet ventilation system comprising:

a. a seat having at least one first slot therein for drawing air from the vicinity of a toilet rim into the seat;

b. a second slot disposed at one end of the seat and in communication with the first slot;

c. a tube having an open first end;

d. anchors for anchoring said tube to a toilet;

e. said seat having a sleeve at said one end for receiving said tube therein, said seat being pivotable about said tube;

f. a tube slot in said tube configured to align with said second slot in said seat when said seat is in a lowered, use position;

g. said sleeve configured to cover said tube slot when said seat is in a raised, non-use position;

h. a duct configured for attachment to said first end of said tube;

i. a fan configured for connection to said duct;

j. an aperture in a second end of said tube, said aperture admitting air to said tube to prevent said fan from stalling when said tube slot is covered.

2. A toilet ventilation system comprising:

a. a seat having at least one first slot therein for drawing air from the vicinity of a toilet rim into the seat;

b. a second slot disposed at one end of the seat and in communication with the first slot;

c. a tube having an open first end;

d. anchors for anchoring said tube to a toilet;

e. said seat having a sleeve at said one end for receiving said tube therein, said seat being pivotable about said tube;

f. a tube slot in said tube configured to align with said second slot in said seat when said seat is in a lowered, use position;

g. said sleeve configured to cover said tube slot when said seat is in a raised, non-use position;

h. said tube having an open first end, configured for connection to a duct and exhaust fan, whereby said fan draws air through said at least one first slot, through said second slot, through said tube slot into said tube, and then into said duct to exhaust odors away from the toilet;

i. said tube further having an aperture in a second end thereof, said aperture admitting air to said tube to prevent said fan from stalling when said tube slot is covered.

* * * * *